United States Patent [19]

Clay, Jr.

[11] Patent Number: 5,022,691

[45] Date of Patent: Jun. 11, 1991

[54] SIDE LOCK FOR A ROLL-UP DOOR

[75] Inventor: Roy T. Clay, Jr., Snyder, N.Y.

[73] Assignee: Whiting Roll-Up Door Mfg. Corp., Akron, N.Y.

[21] Appl. No.: 570,150

[22] Filed: Aug. 17, 1990

[51] Int. Cl.[5] ..... E05C 19/10

[52] U.S. Cl. ..... 292/121; 292/341.13; 292/DIG. 36

[58] Field of Search ..... 292/121, 122, 123, 124, 292/125, 126, 127, 128, 341.13, 24, 25, 56, 240, DIG. 36, DIG. 32

[56] References Cited

U.S. PATENT DOCUMENTS

| | | | |
|---|---|---|---|
| 1,908,165 | 5/1933 | Moler | 292/DIG. 36 |
| 3,642,314 | 2/1972 | Smith | 292/240 |
| 3,740,978 | 6/1973 | Smith | 292/DIG. 36 |
| 3,838,877 | 10/1974 | Hansa | 292/DIG. 36 |
| 3,958,822 | 5/1976 | Germer | 292/DIG. 36 |

*Primary Examiner*—Robert L. Wolfe

*Attorney, Agent, or Firm*—Sommer, Oliverio & Sommer

[57] ABSTRACT

A side lock (20) for a roll-up door (21) mounted on a body includes a keeper (27) mounted on a jamb (23) adjacent an access opening (22). A hook member (28) is pivotally mounted on a panel (25) and is arranged to selectively engage a catch (59) mounted on the keeper. The hook member has an upper cam surface (76) and a concave surface (78). The hook member also has a lower cam surface (75) which is adapted to selectively engage the catch when the door is lowered to selectively displace the hook member against the opposing bias of a spring (91) to permit the tip (66) of the hook member to pass beneath the catch. The improved side lock is self-tightening.

11 Claims, 4 Drawing Sheets

SIDE LOCK FOR A ROLL-UP DOOR

TECHNICAL FIELD

The present invention relates generally to the field of upwardly-acting and roll-up doors, typically found on trucks, trailers, and the like, and, more particularly, to an improved side lock for selectively holding and locking the door in its closed position.

BACKGROUND ART

Roll-up doors are ubiquitous. These doors are commonly found in garages, industrial buildings, and on trucks, trailers, and other vehicles. In such doors, a pair of inwardly-facing inverted L-shaped tracks are typically mounted on a body (i.e., a static structure or the body of a vehicle). A plurality of series-connected panels are operatively mounted for guided articulated movement along the tracks between a lowered substantially-vertical position closing the access opening, and then overhead substantially-horizontal out-of-the-way position.

In some cases, the door, when moved to its closed position, is lockable to a keeper provided on the sill. In other situations, it is desirable to provide a lock between the side(s) of one or more panels and the adjacent jamb(s).

One form of such a side lock has heretofore taken the shape of a butterfly-type latch mounted on the door and selectively engagable with a keeper mounted on the proximate jamb. Such prior art latch typically had a lower cam surface that was adapted to engage the keeper for automatically displacing the latch to an out-of-the way position when the door was lowered. Such latch also had an upper cam surface that was adapted to pass beneath the keeper when the door was closed. This upper cam surface was outwardly- and upwardly-inclined in order that the closed door would be self-tightening during relative vibration between the panels and the jamb. While this inclined upper cam surface was clearly desired to provide the self-tightening feature, its engagement with the keeper also provided a type of inclined plane or wedge. Hence, an intruder could insert an appropriate lever, such as a crowbar or the like, beneath the door, and pry the door upwardly. Upon information and belief, and depending upon the angle of inclination of the upper cam surface, the door would fail (i.e., could be opened by the intruder) by bowing the jamb and proximate portion of the body outwardly in order to permit the latch to pass thereby.

Accordingly, there is believed to be a need for an improved side lock, which is particularly adapted for use in trucks, trailers and other vehicles, which will provide an effective locking mechanism, and which will prevent the door from being defeated by a would-be intruder applying leverage beneath the door.

DISCLOSURE OF THE INVENTION

With parenthetical reference to the corresponding parts, portions or surfaces of the disclosed embodiment for purposes of illustration, this invention provides an improved side lock (i.e., 20) for an upwardly-acting or roll-up door (e.g., 21) mounted on, or adapted to be mounted on, a body to selectively close an axis opening. The body has a jamb (e.g., 23) on either side of the opening. The door has a pair of inverted L-shaped tracks mounted on the jambs in transversely-spaced facing relation to one another. These tracks typically have a lower vertical portion (e.g., 24) an intermediate arcuate or transitional portion, and an overhead substantially-horizontal portion. The door has a plurality (i.e., one or more) of panels (e.g., 25) mounted for guided articulated movement along the tracks between a vertically disposed lowered position effectively closing the opening, and an overhead substantially-horizontal out-of-the-way position permitting axis to the body through the opening.

The improved side lock broadly includes: a keeper (e.g., 27) mounted on at least one of the jambs (and preferably both), the keeper having a catch (e.g., 59) arranged in horizontally-spaced relation to the jamb upon which the keeper is mounted; and a hook member (e.g., 28) pivotally mounted on one of the panels (e.g., 25) for selectively engagement with the catch of the associated keeper. The hook member has a leg portion (e.g., 64) extending away from the pivotal axis (e.g., 80) of the hook member, and has an integral hook portion (e.g., 65) extending away from the distal end of the leg portion. The hook portion terminates in a tip (e.g., 66).

The hook member is continuously biased to move relative to the associated panel about the pivotal axis in one angular direction (e.g., clockwise, as seen in the drawings) such that the leg portion is continuously urged to move toward the catch. The hook portion has a lower cam surface (e.g., 75) adapted to engage the upper surface of the catch when the door is moved toward its lowered or closed position for causing the hook member to pivot about its axis in the opposite angular direction (e.g., counter-clockwise, as seen in the accompanying drawings) to permit the tip to pass beneath the catch. The hook portion has an upper cam surface (e.g., 76) arranged to engage the lower surface of the catch after the tip portion has passed therebeneath, and the hook member has moved in the one angular direction. The hook member also has a concave surface (e.g., 78) arranged between the upper cam surface and the leg portion. The upper cam surface and the concave surface are so dimensioned and configured that, when the door is closed and latched, the catch will be continuously urged to move toward the concave surface during relative vibratory motion between the door and jamb. Hence, if an intruder attempts to pry the door open, the improved side lock will prevent the jamb and body from bowing outwardly.

Accordingly, the general object of this invention is to provide an improved side lock arrangement for an upwardly-acting or roll up door.

Another object is to provide an improved side lock for such a door, which offers the feature of increased security against would-be intruders who might attempt to pry the door open, such as by means of a crowbar or the like.

Still another object is to provide an improved side lock arrangement which is particularly suitable for vehicular applications, and which prevents the proximate portions of the jamb from bowing outwardly if an intruder attempts to pry the door open.

These and other objects and advantages will become apparent from the foregoing and ongoing written specification, the drawings, and the appended claims.

MODE(S) OF CARRYING OUT THE INVENTION

Figures 1, 2:
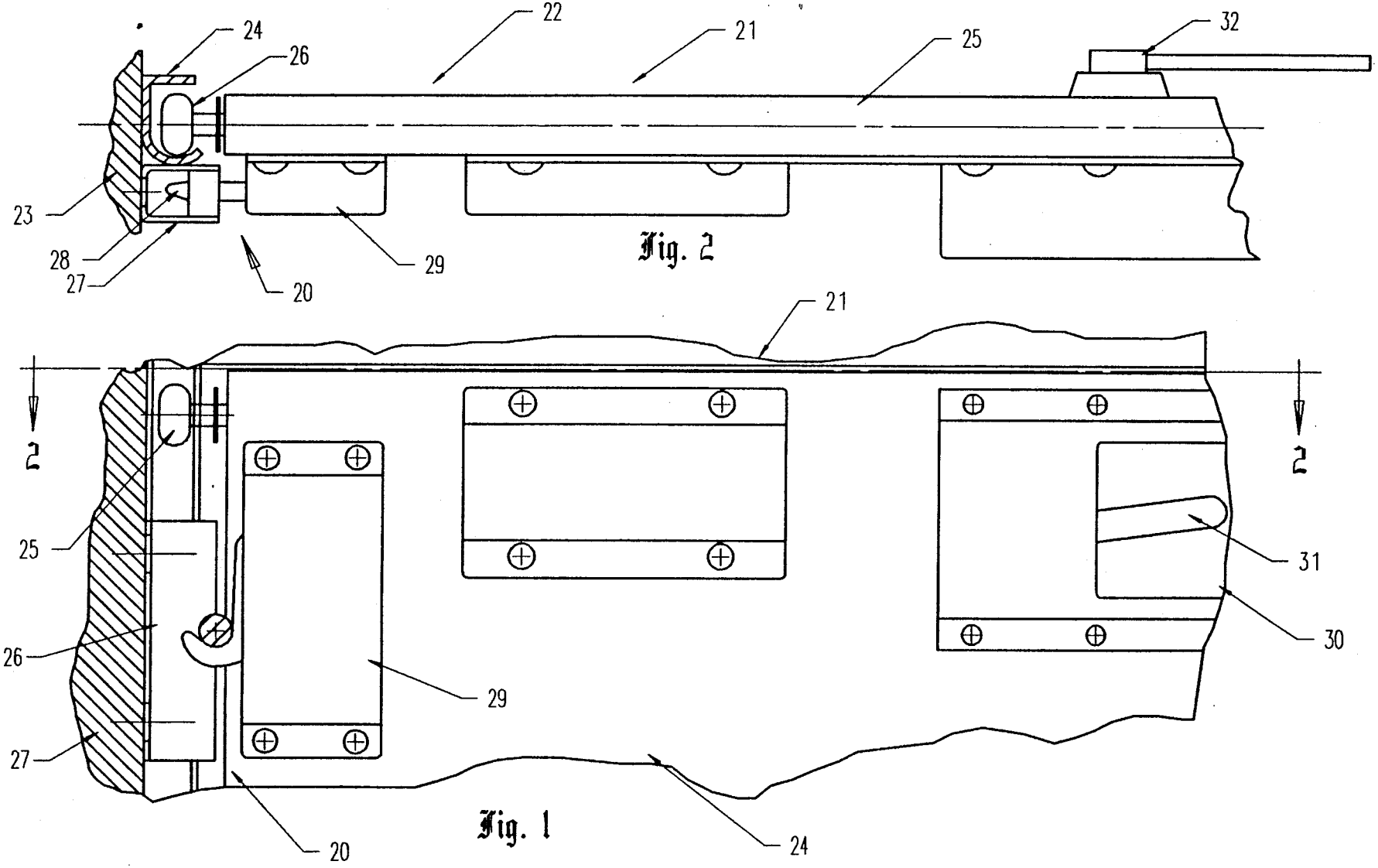
FIG. 1 is a fragmentary vertical view, partly in section and partly in elevation, of the inside surface of a roll-up truck door incorporating the improved side lock.
FIG. 2 is a fragmentary horizontal view, again partly in section and partly in elevation, taken generally on line 2—2 of FIG. 1, showing the panel upon which the improved lock is mounted in top plan.

At the outset, it should be clearly understood that lifer reference numerals are intended to identify the same structural elements, portions or surfaces consistently throughout the several drawings figures, as such elements, portions or surfaces may be further described or explained by the entire written specifications, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and, more particularly to FIGS. 1 and 2 thereof, the present invention provides an improved side lock assembly, generally indicated at 20, for use in association with an upwardly-acting or roll-up door, generally indicated at 21, which is adapted to be mounted on a stationary or static structure, or mounted on a vehicle body (not fully shown) to selectively close an access opening 22 therethrough. In FIGS. 1 and 2, the body is fragmentarily shown as including a portion of a left jamb 23. Persons skilled in this art will readily appreciate that the right side of the opening would be provided with a similar jamb.

The door has a pair of inverted L-shaped tracks mounted on the jambs in transversely-spaced facing relation to one another. In the usual manner, the tracks have vertically-disposed lower portions, one of which is indicated at 24, intermediate arcuate transitional portions (not shown), and horizontally-disposed overhead or upper portions (not shown). The door includes a plurality (i.e., one or more) of panels, one of which is indicated at 25. A plurality of rollers, one of which is indicated at 26, extend transversely beyond the ends of the associated panel, and are received in the track in the conventional manner. These rollers may have their shafts received in recessed provided in interfitting hinge sections provided between the adjacent panels, or may be attachable-type devices, as desired. In any event, the door 21 has a plurality of panels mounted for guided articulated movement along the tracks between a substantially-vertical closed position (as fragmentarily shown in FIGS. 1 and 2), and an overhead substantially-horizontal out-of-the-way position permitting access to the body or structure through opening 22.

The improved side lock 20 includes a keeper 27 mounted on the jamb, and a hook member 28 pivotally mounted on one of the panels for selective engagement with the keeper. In FIGS. 1 and 2, the hook member is shown as being protectively enclosed by a suitable cover 29, which has been removed from the other views. The door is shown as further including a handle assembly 30 mounted in the center of the door. This handle assembly has a recessed handle 31 facing into the body, and has an exterior handle 32 associated with a lock (not shown). Either handle may be grasped and suitably rotated so as to cause hook member 28 to move to an out-of-the-way position disengaged from the keeper, so as to permit the door to be raised.

Figure 3:
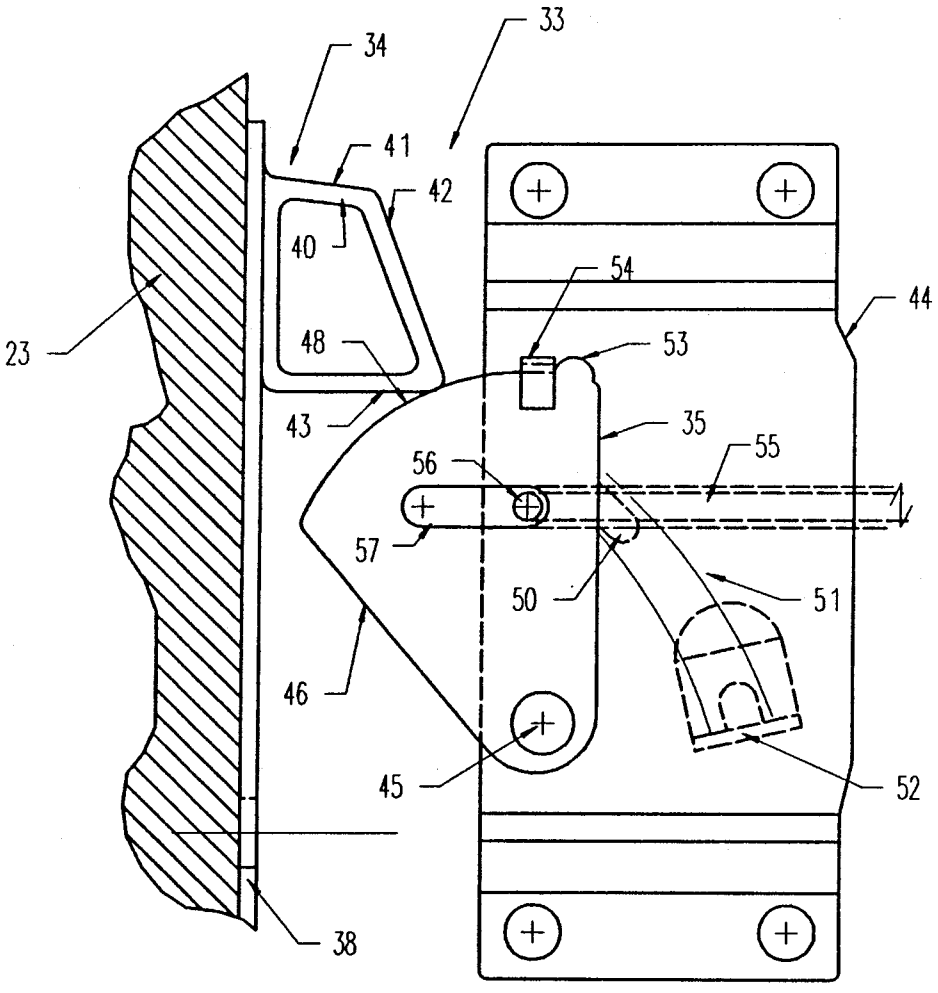
Fig. 3 (PRIOR ART)
FIG. 3 is a fragmentary inside elevational view, partly in section and partly in elevation, of a prior art locking mechanism incorporating a butterfly-type latch, this view showing the catch as being operatively arranged beneath a portion of the keeper.

Prior Art Arrangement (FIG. 3)

Before proceeding, it is deemed advisable to review a prior art side lock mechanism, in order that the advantages of the improved side lock 20 may be understood in context.

Referring now to FIG. 3, a prior art side lock mechanism, generally indicated at 33, is shown as including a keeper 34 mounted on a jamb 23, and a butterfly-type latch 35 pivotally mounted on one panel (not shown) for selective engagement with the keeper. The keeper is shown as having a vertical plate-like portion 38 adapted to be secured to the jamb by means of suitable fasteners (not shown). A horizontally-elongated tubular catch 40 is mounted on the upper marginal end portion of plate 38. Catch 40 is shown as having a substantially-trapexoidal transverse cross-section and has an outer surface which includes, in pertinent part, an upwardly- and rightwardly-facing inclined planar surface 41, an upwardly- and rightwardly-facing inclined planar surface 42 extending downwardly from the right margin of surface 41, and a downwardly-facing horizontal planar surface 43 extending leftwardly from the lower margin of surface 42. The various transitional portions between surfaces 41,42 and 42,43 are shown as being rounded.

Latch 35 is shown as being a pie-shaped member mounted in a plate 44 affixed to the door for pivotal movement about an axis 45. More particularly, latch 35 is shown as including, in pertinent part: a downwardly- and leftwardly-facing planar surface 46, an upwardly- and downwardly-facing arcuate surface 48, and a rightwardly-facing planar substantially-vertical surface 49 from which a tongue 50 extends rightwardly. A coil spring 51, represented by the center-lines, is operatively arranged to act between tongue 50 and an out-struck tab 52 provided on plate member 44. Spring 51 is compressed and continuously urges latch 35 to rotate in a counter-clockwise direction about pivotal axis 45. A lug 53 extends outwardly from the right marginal end portion of arcuate surface 48 and is arranged to abut an out-struck tab 54 provided on member 44 to limit for the motion of the latch in the counter-clockwise direction. A bent-rod or cable 55 has an appropriate fitting 56 at its left distal end suitable received within a horizontally-elongated slot 57 provided in the latch. Thus, either handle may be suitable rotated to pull cable 55 rightwardly, thereby pivoting latch 35 in a clockwise direction about axis 45 against the opposing bias of spring 51 to permit the door to be raised.

Latch surface 46 functions as an inclined plane to engage the keeper as the door is closed. The lost-motion connection between cable terminus 56 and slot 57 permits the latch to move in a clockwise direction about axis 45 when the door is closed, without either handle having been rotated. Latch surface 48 was preferably an arcuate surface to render the door self-tightening when the door was closed and the panel vibrated relative to the keeper. In other words, spring 51 continuously biased latch 35 to pivot in a counter-clockwise direction, thereby tending to ever tighten the engagement of the latch with the keeper. At the same time, the nature of surface 48 provides a type of inclined plane to attempt to force the door open. Hence, if an intruder were to insert a suitable lever, such as a crowbar, under the lowermost panel, and attempted to force the door open, the upward force exerted by the intruder would have an leftwardly-directed horizontal component transmitted from the latch to the keeper. This tended to bow the jamb outwardly (i.e., leftwardly in FIG. 3). Ultimately, if sufficient force were to be applied, the jamb might bow outwardly to a degree sufficient to permit the latch to pass by the keeper, thereafter allowing the door to be raised. Thus, in this prior art arrangement, the self-tightening feature provided the means by which the door could be defeated by an intruder.

The Improved Side Lock

Figures 5, 6, 7, 8, 9, 10:
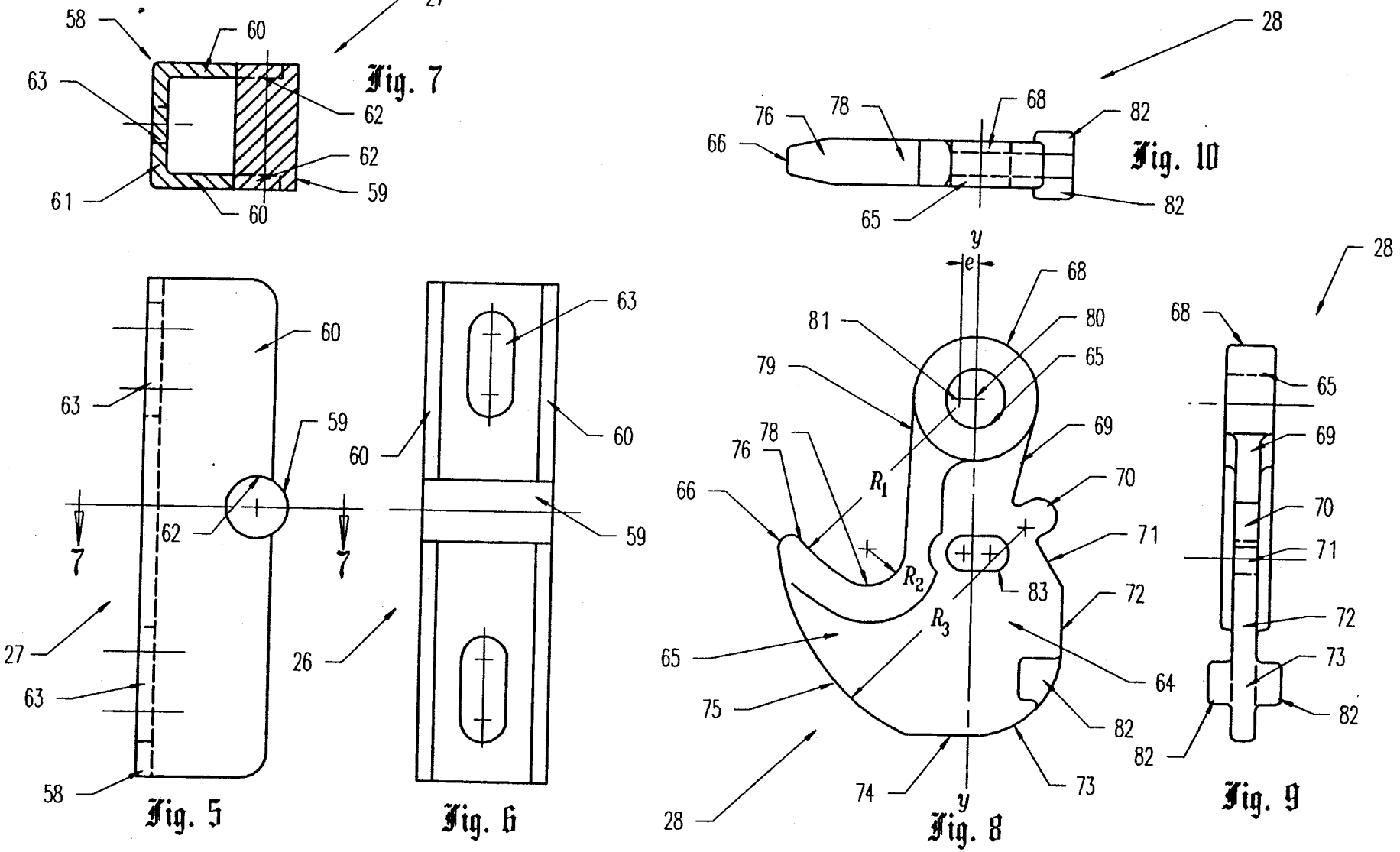
FIG. 5 is a front elevation of the keeper used in the improved side lock.
FIG. 6 is a right side elevation of the keeper show in FIG. 5.
FIG. 7 is a horizontal sectional view of the improved keeper, taken generally on line 7—7 of FIG. 5, showing the catch as being operatively held between the distal ends of the flanges.
FIG. 8 is a front elevation of the improved hook member.
FIG. 9 is a right side elevation of the hook member shown in FIG. 8.
FIG. 10 is a top plane view of the hook member shown in FIG. 8.

Referring now to FIGS. 5–7, the improved keeper 27 is shown as broadly including a vertically-elongated channel portion 58 and a catch portion 59. The channel portion 58 is shown as having a pair of horizontally-spaced flanges 60,60 extending outwardly from a central intermediate web portion 61. Catch member 59 is shown as being a horizontally-elongated cylindrical rod having its marginal end portions suitably received in arcuate recesses 62,62 provided in the flanges. Catch 59 may be operatively retained in this position by means of a suitable weldment (not shown). As best shown in FIG. 6, a pair of vertically-elongated slots, severally indicated at 63, are provided through the web portion to accommodate passage of the shank portions of suitable fasteners (not shown) by which keeper 27 may be operatively mounted on jamb 23.

Referring now to FIGS. 8–10, hook member 28 is shown as being an integrally-formed solid cast element, and has a leg portion 64 extending downwardly from an opening 65, the center of which is the pivotal axis for the hook member. A hook portion 65 extends leftwardly away from the lower margin of the leg portion and terminates in a leftwardmost tip 66. More particularly, as shown in FIG. 8, hook member 28 is sequentially bounded by: an upwardly-facing semi-cylindrical surface 68, a rightwardly- and downwardly-facing planar surface 69 extending downwardly from the right margin of surface 68, an arcuate surface 70 surrounding rightwardly- and upwardly-extending tab portion, a rightwardly- and upwardly-facing inclined planar surface 71, a downwardly-facing horizontal planar surface 74, a downwardly- and leftwardly-facing arcuate cam surface 75 of radius $R_3$, tip portion 66, an upper cam surface 76 of radius $R_1$, a concave cylindrically-segmented surface 78 of radius $R_2$, and a leftwardly-facing planar surface 79 continuing upwardly therefrom to rejoin the left margin of semi-cylindrical surface 68. The upper margin of lower cam surface 75 tangentially joins the lower margin of tip surface 66. Similarly, the right margin of tip surface 66 tangentially joins upper cam surface 76, and the lower margin of upper cam surface 76 tangentially joins cylindrical concave surface 78.

Figure 4:
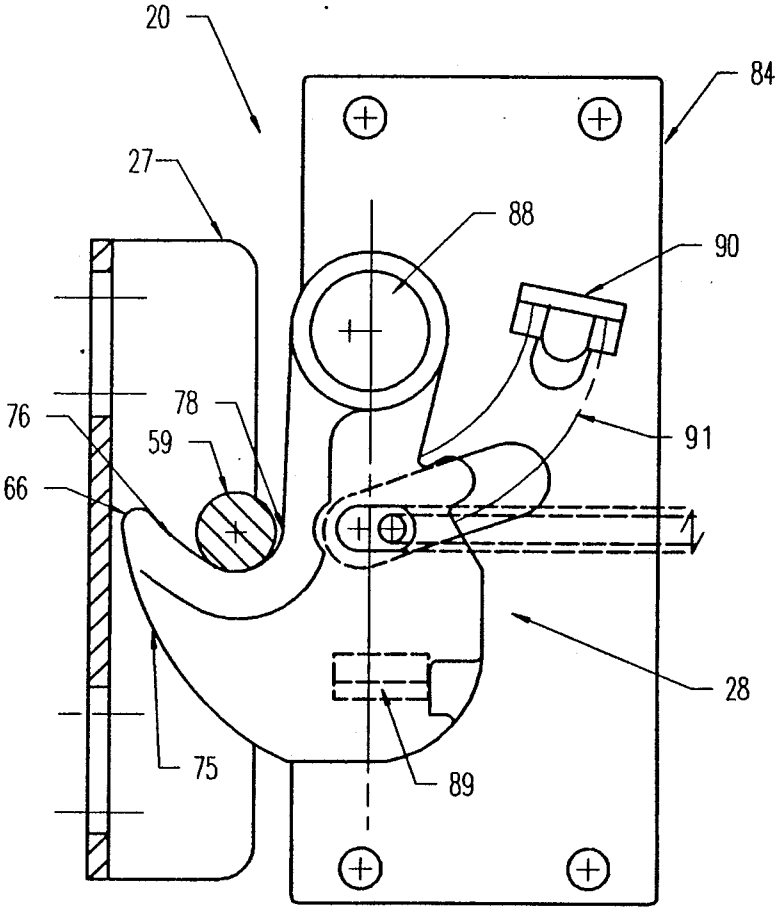
FIG. 4 is a fragmentary view, partly in section and partly in elevation, of the improved locking mechanism, this view showing the hook member as having been rotated to its extreme position in a clockwise direction, and further showing the catch as operatively engaging the concave surface of the hook member.

As previously noted, lower cam surface 75 is arcuate and of radius $R_3$, upper cam surface 76 is also arcuate but of radius $R_1$, and concave surface 78 is cylindrical and of radius $R_2$. The pivotal axis of the hook member is indicated at 80. The axis 81 of upper cam surface 76 is displaced leftwardly and horizontally from pivotal axis 80 by an eccentric distance e. A pair of lugs, severally indicated at 82, extend horizontally outwardly from the hook member adjacent surface 73. The upper rim portion of the hook member between tip 66 and semi-cylindrical surface 68 is shown as being horizontally thickened. The hook member is shown as being further provided with a horizontally-elongated slot 83 to accommodate the terminus 56 of cable 55, as shown in FIG. 4.

FIG. 8 is generally drawn to scale. In the preferred embodiment radius $R_1$ is about 1.750 inches, radius $R_2$ is about 0.266 inches, radius $R_3$ is about 2,000 inches , and eccentric distance e is about 0.125 inches. Thus, the ratio of radius $R_1$ to eccentric distance e is about 14 (i.e., $1{,}750/0.125=14$), the ratio of radius $R_1$ to radius $R_3$ is about 7, and the ratio of radius $R_3$ to radius $R_1$ is about 1.125. The center of lower cam surface 75 is on an imaginary projection of surface 71.

Figures 11, 12, 13:
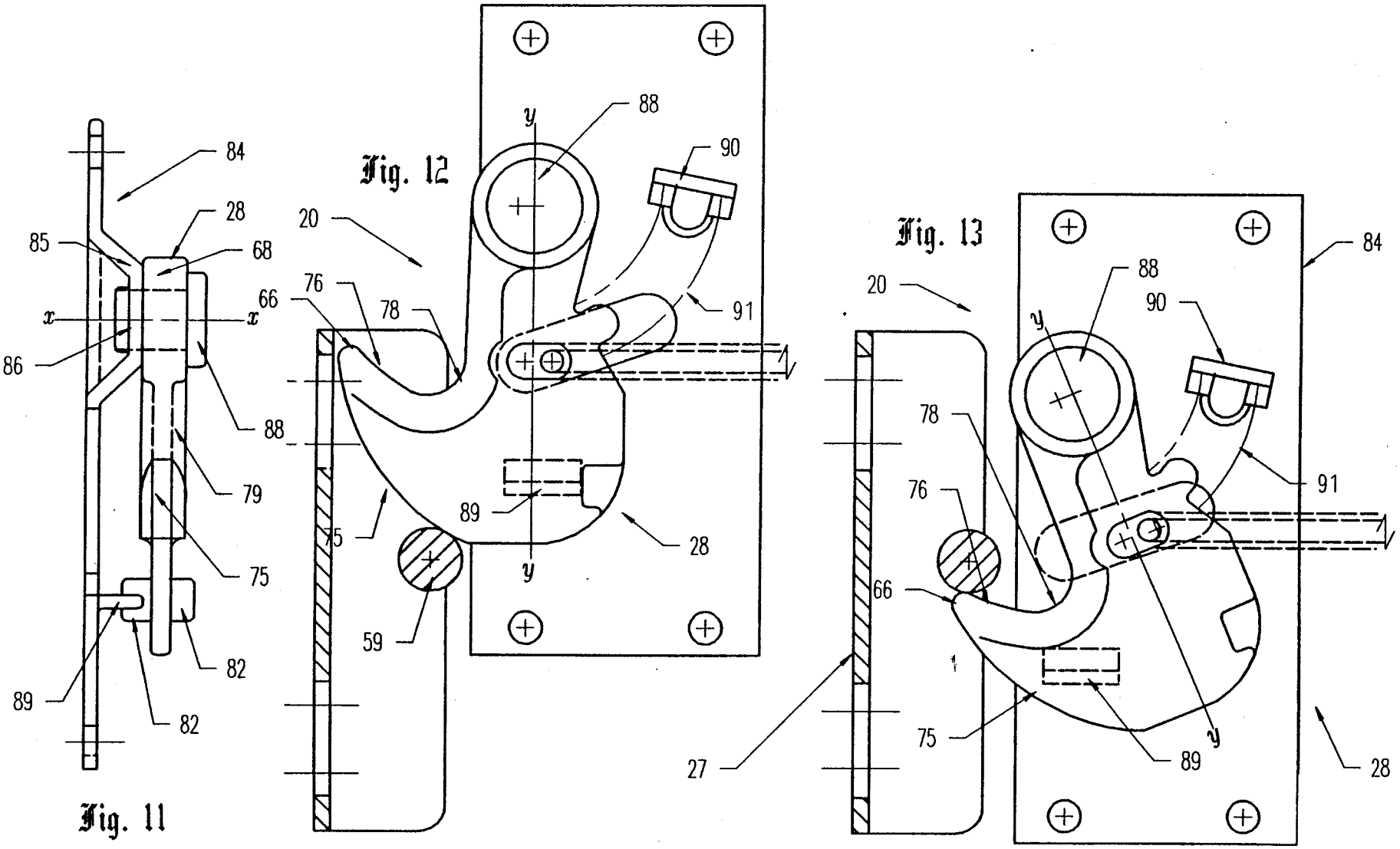
FIG. 11 is a left end elevation of the hook member and the mounted plate.
FIG. 12 is a schematic view similar to FIG. 4, showing the hook member lower cam surface engaging the upper surface of the catch when the door is lowered.
FIG. 13 is a schematic view similar to FIG. 12, but shows the hook member as having been rotated through an arc of approximately 22° in a counter-clockwise direction from the position shown in FIG. 12, this view also showing the marginal end portion of the upper cam surface adjacent the tip portion as engaging the underside of the catch.

As best shown in FIGS. 4 and 11–13, the improved hook member 28 is adapted to be pivotally mounted on a plate, generally indicated at 84, which is adapted to be mounted on the inside surface of panel 25. When seen in front elevation (FIGS. 4 and 12–13) the plate appears to present a vertically-elongated substantially-rectangular outline. However, as shown in FIG. 11, the plate has an outwardly struck portion 85, which portion is provided with a horizontal through-hole 86. Hence, a suitable fastener, indicated at 88 in FIG. 11, is adapted to be passed through hook member hole 65 and plate opening 86, to rotatively mount the hook member on the mounting plate. Thus, the hook member is mounted for pivotal movement about horizontal axis x—x.

Plate member 84 is shown as having an outwardly-struck tab portion 89 which is aligned with, and constitutes an abutment stop for one of hook member lugs 82,82. Member 84 is also provided with another outwardly-struck tab 90, which has a tongue arranged substantially parallel to the front surface of the plate.

A coil spring 91 has one marginale nd portion encircling hook member tab surface 70, and has its other marginal end portion surrounding the tongue of plate member tab 90. Spring 91 is compressed, and continuously urges the hook member to rotate about pivotal axis 80 in a clockwise direction relative to the plate. Thus, the hook member leg portion 74 is continuously biased to move toward the catch, and hook member lug 82 is continuously biased to move toward tab 89. As shown in FIG. 4, the terminal end 56 of a cable 55 is arranged in hook member slot 83. The other end of cable 55 is operatively associated with handles 31 and 32, such that rotation of the handles will pull cable 55 rightwardly, thereby causing the hook member to rotate in a counter-clockwise direction to the plate and keeper.

The operation of the improved side lock is comparatively illustrated in FIGS. 4, 12 and 13. Referring to FIG. 12, when the door is lowered toward its closed position, the hook member lower cam surface 75 will first engage the upper surface of catch 59. As the door continues to move downwardly, the hook will be forced to pivot in a counter-clockwise direction relative to place 84 to an out-of-the-way position permitting the hook member tip portion 66 to pass beneath the catch. As shown in FIG. 13, once the tip portion 66 is beneath the catch, spring 91 will expand to cause the lower portion of catch 59 to engage the marginal end portion of hook member upper cam surface 76. The spring will continue to expand until the force exerted by catch 59 on hook member upper cam surface 76 equals the opposing bias exerted by the spring. Thereafter, as the door moves further downwardly relative to the keeper, as by vibration or for any other reason, the hook member will continue to move in a clockwise direction about axis 80 until the catch becomes seated in hook member concave surface 78, as shown in FIG. 4. Thus, the improved hook member is self-tightenting. Importantly, when the catch engages upper cam surface 76 any force component exerted by the hook on the catch will urge the jamb to move inwardly, rather than outwardly. When the catch engages concave surface 78, there will be not substantial lateral force component transmitted from the hook member to the catch.

As previously indicated, levers 31 or 32 may be selectively rotated to cause cable 55 to move rightwardly, thereby causing the hook member to rotate in a counter-clockwise direction, to cause the hook portion to become disengaged from catch 59, thereby permitting the door to be raised. It should also be noted that, when the door is intentionally opened, cam surface 76 moves away from its engagement with catch 59.

Modifications

The present invention contemplates that many changes and modifications may be made. In a typical arrangement, the improved side lock is provided on the left and right marginal end portions of a particular panel, for engagement with keepers provided on the adjacent jambs. The particular shape and ocnfiguration of the keeper and catch may be changed or modified as desired. Similarly, the particular means or mechanism by which the keeper is mounted on the jamb may also be changed.

While the hook member shown in the accompanying drawings and described here and above is preferred, persons skilled in this art will readily appreciate that additional changes and modifications thereto may be made. For example, the specific dimensions of the hook member may be changed, as well as the radii of the lower cam surface, the upper cam surface and the concave surface. Other types of hook-moving means may be substituted for the lost-motion cable connection shown. The hook member may be biased by other types of springs and resilient members, which may appear differently than the particular configuration shown in the accompanying drawings. The stop lugs 82 may also be changed as desired.

Therefore, while the preferred form of the improved side lock has been shown and described, and several modifications thereof discussed, persons skilled in this art will readily appreciate that various additional changes and modifications may be made without departing from the spirit of the invention, as defined and differentiated by the following claims.

What is claimed is:

1. A side lock for a roll-up door mounted on a body to selectively close an opening, said body having a jamb on either side of said opening, said door having a pair of inverted L-shaped tracks mounted on said jambs in transversely-spaced facing relation to one another, said door having a plurality of panels mounted for guided articulated movement along said tracks between a vertically-disposed position closing said opening and an overhead substantially-horizontal out-of-the-way position permitting access to said body through said opening, said side lock comprising:

a keeper mounted one of said jambs, said keeper having a catch arranged in spaced relation to said jamb; and a hook member pivotally mounted on one of said panels for selective engagement with said catch, said hook member having a leg portion extending away from said pivotal axis and having a hook portion extending away from said leg portion and terminating in a tip, said hook member being biased to rotate relative to said one panel about said pivotal axis in one angular direction such that said leg portion is continuously urged to move toward said catch, said hook portion having a lower cam surface adapted to engage said catch when said door is moved toward said closed position for causing said hook member to rotate about said axis in the opposite angular direction to permit said tip to pass beneath said catch, said hook portion having an upper cam surface arranged to engage said catch surface after said tip portion has passed beneath said catch, said hook member also having a concave surface arranged between said upper cam surface and said leg portion, said upper cam surface and said concave surface being so dimensioned and configured that said catch will be urged to move toward said concave surface during relative vibratory motion between said jamb and panel when said upper cam surface engages said catch.

2. The side lock as set forth in claim 1 wherein said keeper includes a channel-shape member having two flanges portions extending outwardly from an intermediate web, and wherein said catch is mounted on said flange portions.

3. The side lock as set forth in claim 2 wherein said catch has a cylindrical outer surface.

4. The side lock as set forth in claim 1, and further comprising: a spring acting between said panel and hook member for urging said hook member to move in said one angular direction.

5. The side lock as set forth in claim 1 wherein said tip separates said upper and lower cam surfaces.

6. The side lock as set froth in claim 1 wherein said concave surface is a cylindrical segment.

7. The side lock as set forth in claim 1 wherein said concave surface tangentially joins one margin end portion of said upper cam surface.

8. The side lock as set forth in claim 1 wherein said upper cam surface is generated about an axis eccentric to said pivotal axis.

9. The side lock as set forth in claim 8 wherein the ratio of the radius of said upper cam surface to the eccentric distance from said pivotal axis to the point about which said upper cam surface is generated is about 14.

10. The side lock as set forth in claim 1 wherein the ratio of the radii of said upper cam surface to said concave surface is about 6.58.

11. The side lock as set forth in claim 1 wherein the ratio of the radius of said lower cam surface to the radius of said upper cam surface is about 1.125.

* * * * *